US011000861B2

(12) United States Patent
Wu et al.

(10) Patent No.: US 11,000,861 B2
(45) Date of Patent: May 11, 2021

(54) SHOWERS

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 140 days.

(21) Appl. No.: 16/232,351

(22) Filed: Dec. 26, 2018

(65) Prior Publication Data

US 2020/0206753 A1 Jul. 2, 2020

(51) Int. Cl.
*B05B 1/18* (2006.01)
*B05B 1/02* (2006.01)

(52) U.S. Cl.
CPC ..... *B05B 1/185* (2013.01); *B05B 1/02* (2013.01)

(58) Field of Classification Search
CPC ..... B05B 1/1636; B05B 1/185; B05B 1/02; B05B 12/04; B05B 1/169
USPC ..... 239/443–446, 561, 563
See application file for complete search history.

(56) References Cited

U.S. PATENT DOCUMENTS 6,290,147 B1 * 9/2001 Bertrand ..... B05B 1/1618 239/444
6,425,537 B1 * 7/2002 Nielsen ..... A62C 31/07 239/443
8,910,887 B2 * 12/2014 Helmsderfer ..... B05B 15/625 239/289
2010/0237160 A1 * 9/2010 Miller ..... B05B 1/1681 239/1
2014/0054391 A1 * 2/2014 Schroeder ..... B05B 1/1609 239/11
2020/0206753 A1 * 7/2020 Wu ..... B05B 1/1636

* cited by examiner

*Primary Examiner* — Christopher S Kim
(74) *Attorney, Agent, or Firm* — Birch, Stewart, Kolasch & Birch, LLP

(57) ABSTRACT

A shower includes a main body and a control member. The main body includes an inner wall composed an accommodating space, an inlet opening, multiple outlet openings, an inlet bore and multiple outlet bores; the inlet opening communicates with the inlet bore through an inlet channel in the main body; each of the outlet openings communicates with a corresponding one of the outlet bores through an individual outlet channel; the control member is positioned in the accommodating space, wherein the control member could be operated to select one of the outlet opening being able to outlet.

20 Claims, 15 Drawing Sheets

SHOWERS

BACKGROUND OF THE INVENTION

1. Technical Field

The present disclosure relates generally to a shower, and more particularly to a shower facility having outlets in three directions.

2. Description of Related Art

Showers are an essential equipment for taking a shower in human life. A conventional shower usually has only one outlet in one direction; for example, the conventional shower has only a spray portion without different spray modes. Therefore, the conventional shower could not provide various spray mode for users. Though some improved shower provide different spray modes, so that the user could select a desired spray mode during showering. However, such shower having various spray modes still has only one outlet in one direction, whereby it is still inconvenient for users during use since the conventional shower provides merely single outlet direction which is mainly used to take a shower.

At least for the above reasons, conventional showers still have room for improvements.

BRIEF SUMMARY OF THE INVENTION

In view of the above, the primary objective of the present disclosure is to provide a shower including at least three outlets in three directions, whereby to provide different outlet functions for users during use.

The present disclosure provides a shower includes a main body and a control member. The main body includes an outer wall, an inner wall and a rear wall, wherein the rear wall has a circular hole, the inner wall is connected to the rear wall at an edge of the circular hole, and the outer wall is connected to an outer edge of the rear wall. The inner wall is composed an accommodating space. The outer wall includes an inlet opening, and at least three outlet openings. The inner wall includes an inlet bore, and at least three outlet bores. The inlet opening communicates with the inlet bore through an inlet channel in the main body. Each of the outlet openings communicates with a corresponding one of the outlet bores through an individual outlet channel. The control member is positioned in the accommodating space, wherein the control member could be operated to select one of the outlet opening being able to outlet.

With the aforementioned design, the control member of the shower could be operated to stay at the closed position or one of the outlet mode positions. When the control member stays at one of the outlet mode positions, only one outlet bore is open, and other outlet bores are respectively plugged by one of the elastic blocks, whereby the shower could provide a desired outlet function for users during use. Alternatively, all the outlet bores are respectively plugged by one of the elastic blocks when the control member stays at the closed position.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
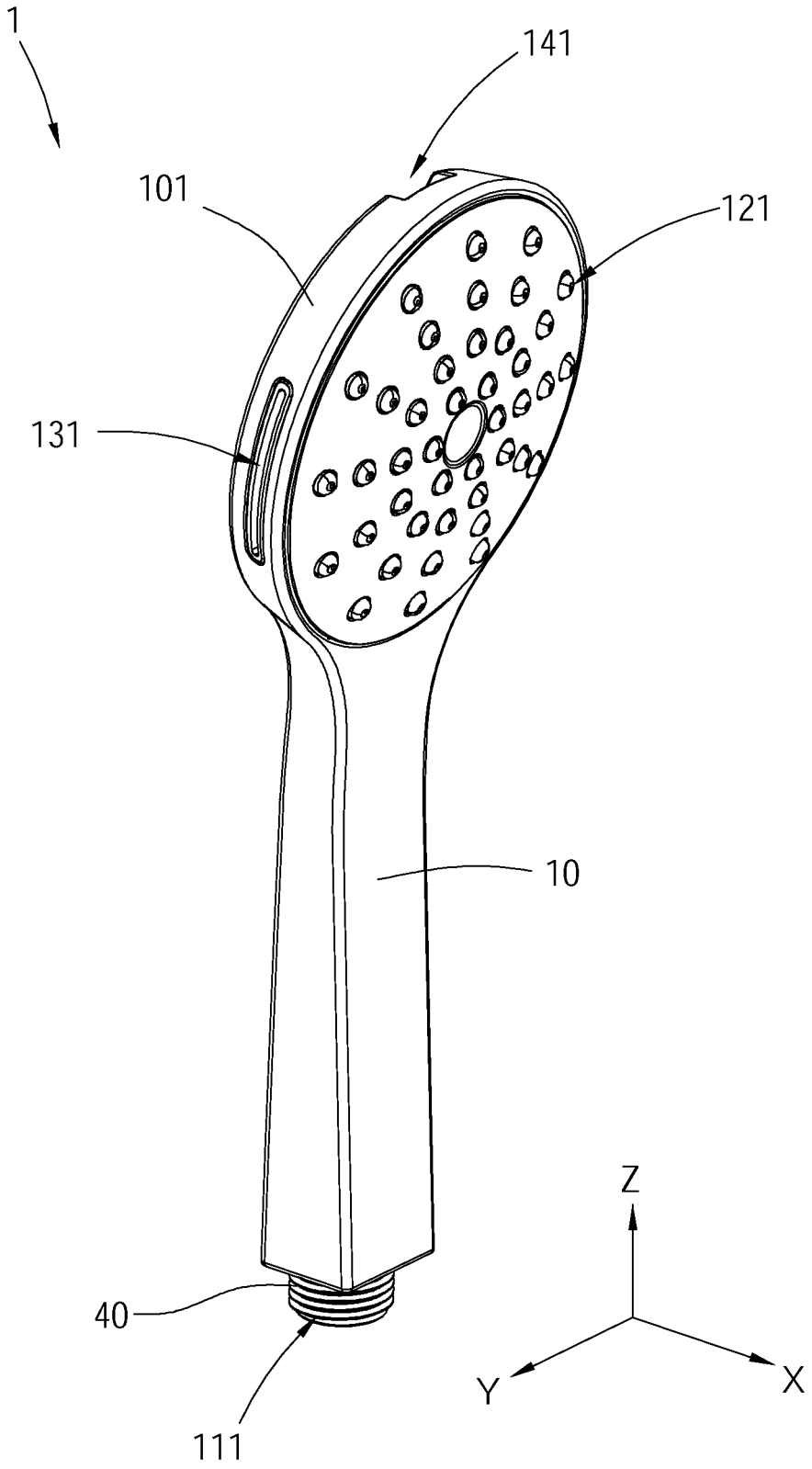
FIG. 1 is a perspective view of a shower of one embodiment of the present disclosure.

As illustrated in FIG. 1 to FIG. 6, a shower 1 is provided, including a main body 10 and a control member 20. The main body 10 includes an outer wall 101, an inner wall 103 and a rear wall 102. The rear wall 102 has a circular hole 1021, the inner wall 103 is connected to the rear wall 102 at an edge of the circular hole 1021, and the outer wall 101 is connected to an outer edge of the rear wall 102.

The inner wall 103 is composed an accommodating space 1032, and a projection of the accommodating space 1032 fully overlaps the circular hole 1021. In addition, the control member 20 is positioned in the accommodating space 1032 of the inner wall 103 of the main body 10.

The outer wall 101 has an inlet opening 111, and at least three outlet openings 121, 131, 141. The inner wall 103 has an inlet bore 113, and at least three outlet bores 123, 133, 143. The inlet opening 111 communicates with the inlet bore 113 through an inlet channel 112 in the main body. Further, each of the outlet openings 121, 131, 141 communicates with a corresponding one of the outlet bores 123, 133, 143 through an individual outlet channel 122, 132, 142. In other words, the outlet opening 121 communicates with the outlet bore 123 through the outlet channel 122 independently of the inlet channel 112 and the other outlet channels 132, 142;

the outlet opening 131 communicates with the outlet bore 133 through the outlet channel 132 independently of the inlet channel 112 and the other outlet channels 122, 142; the outlet opening 141 communicates with the outlet bore 143 through the outlet channel 142 independently of the inlet channel 112 and the other outlet channels 122, 132.

Figure 3:
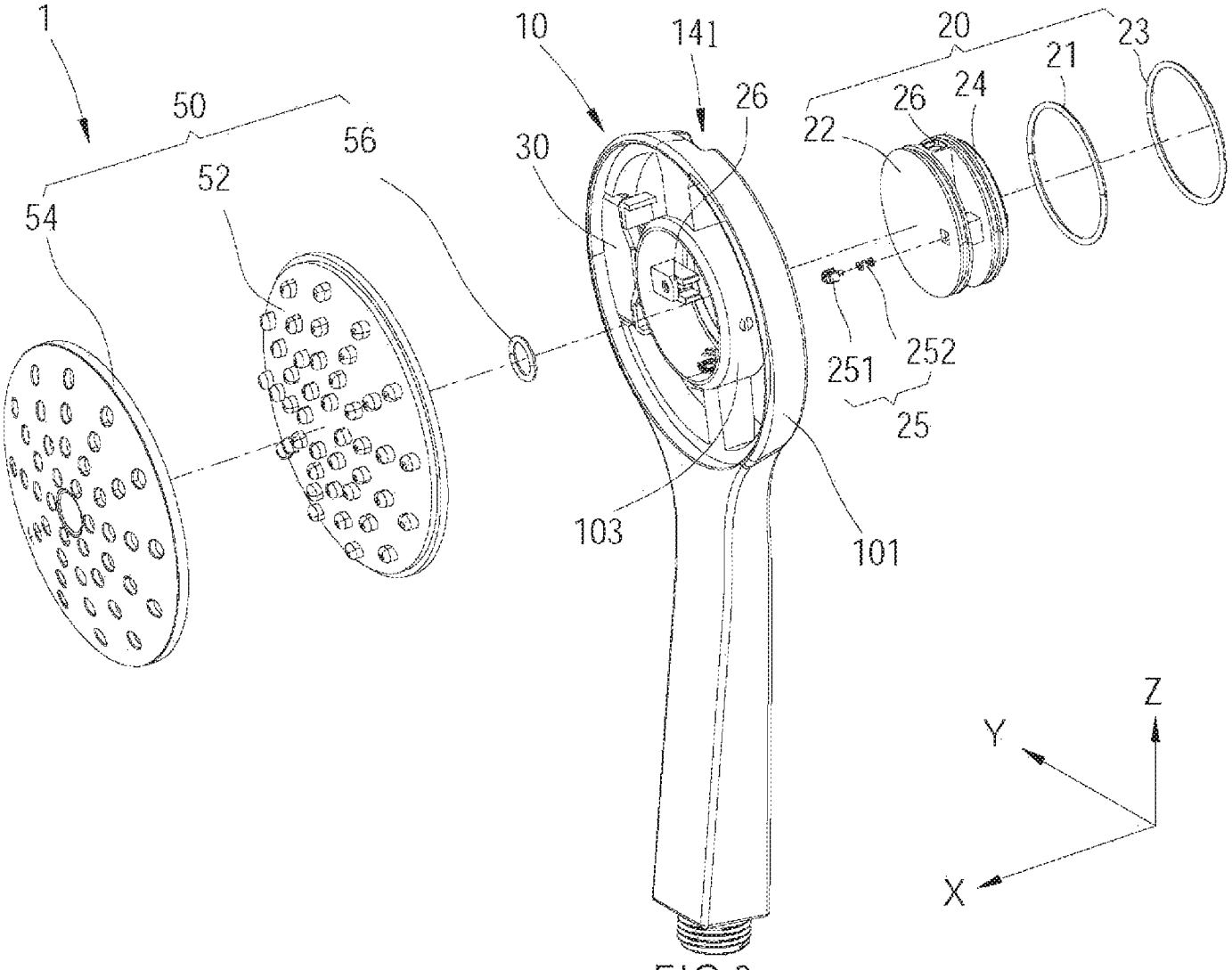
FIG. 3 is a partial exploded view of the shower of one embodiment of the present disclosure.
Figure 4:
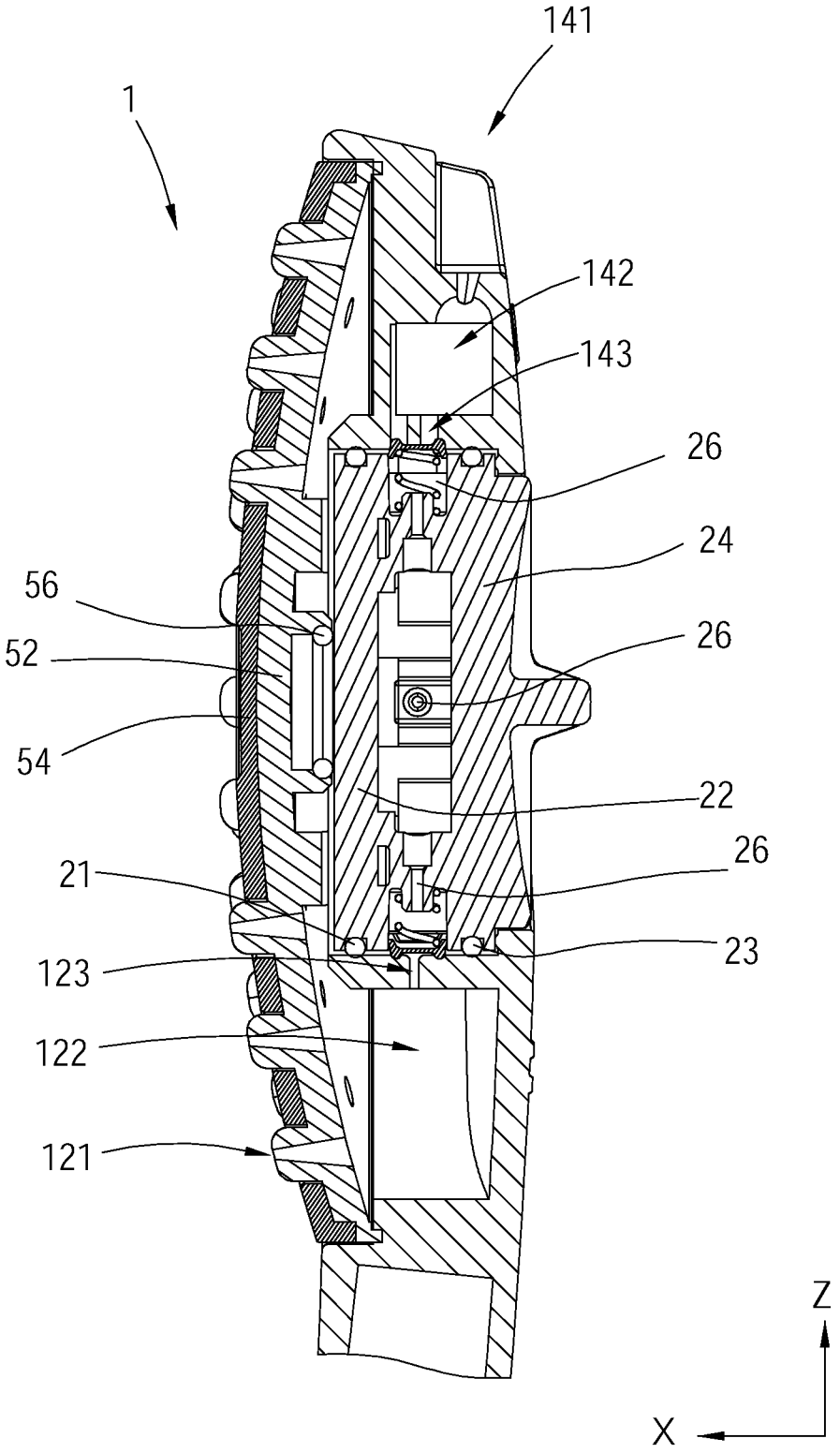
FIG. 4 is a cross-sectional view of the shower of one embodiment of the present disclosure.
Figure 5:
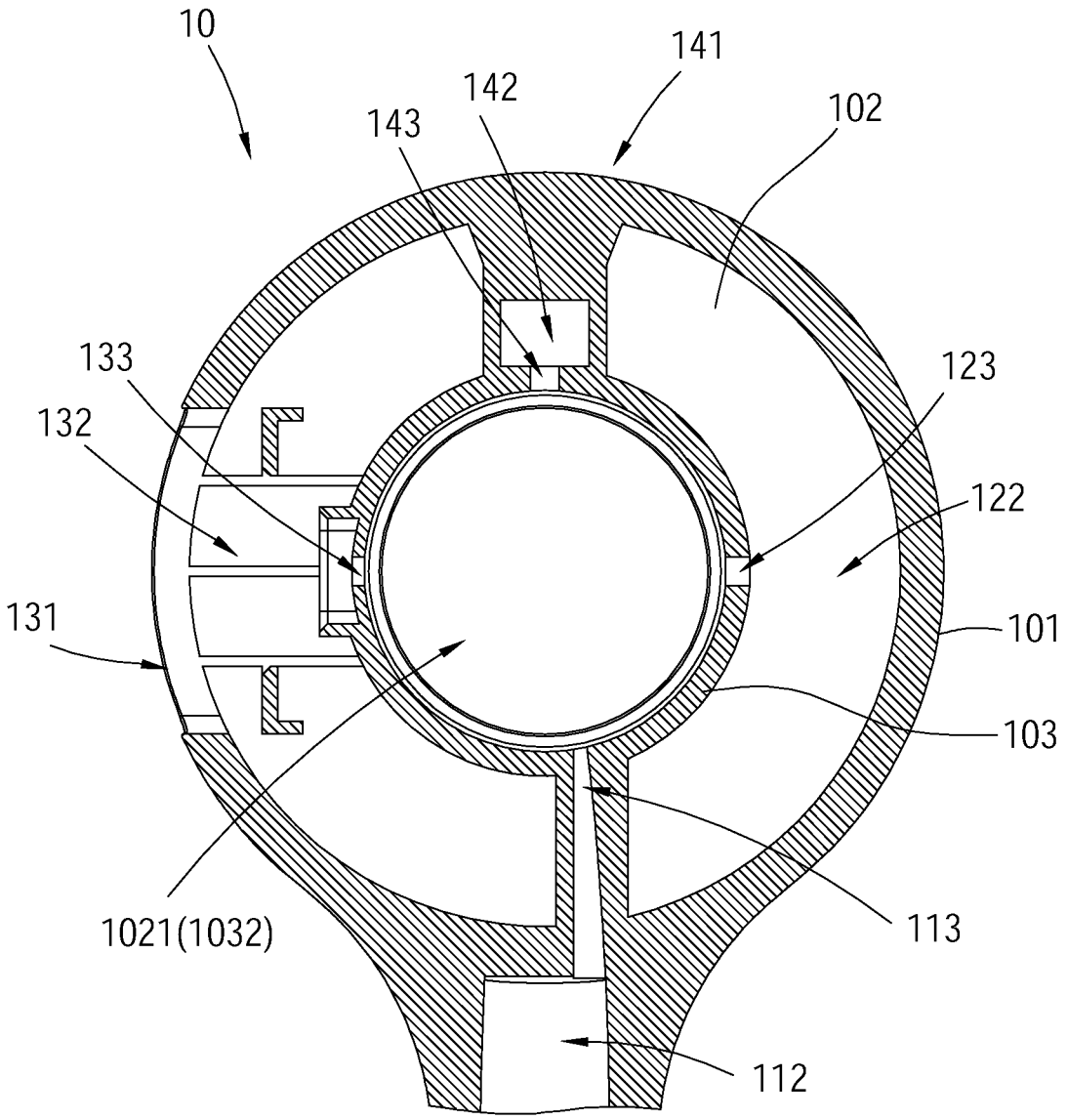
FIG. 5 is a cross-sectional view of a main body of the shower of one embodiment of the present disclosure.
Figure 5:
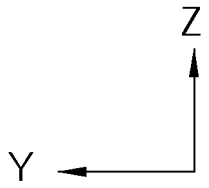
Figure 6:
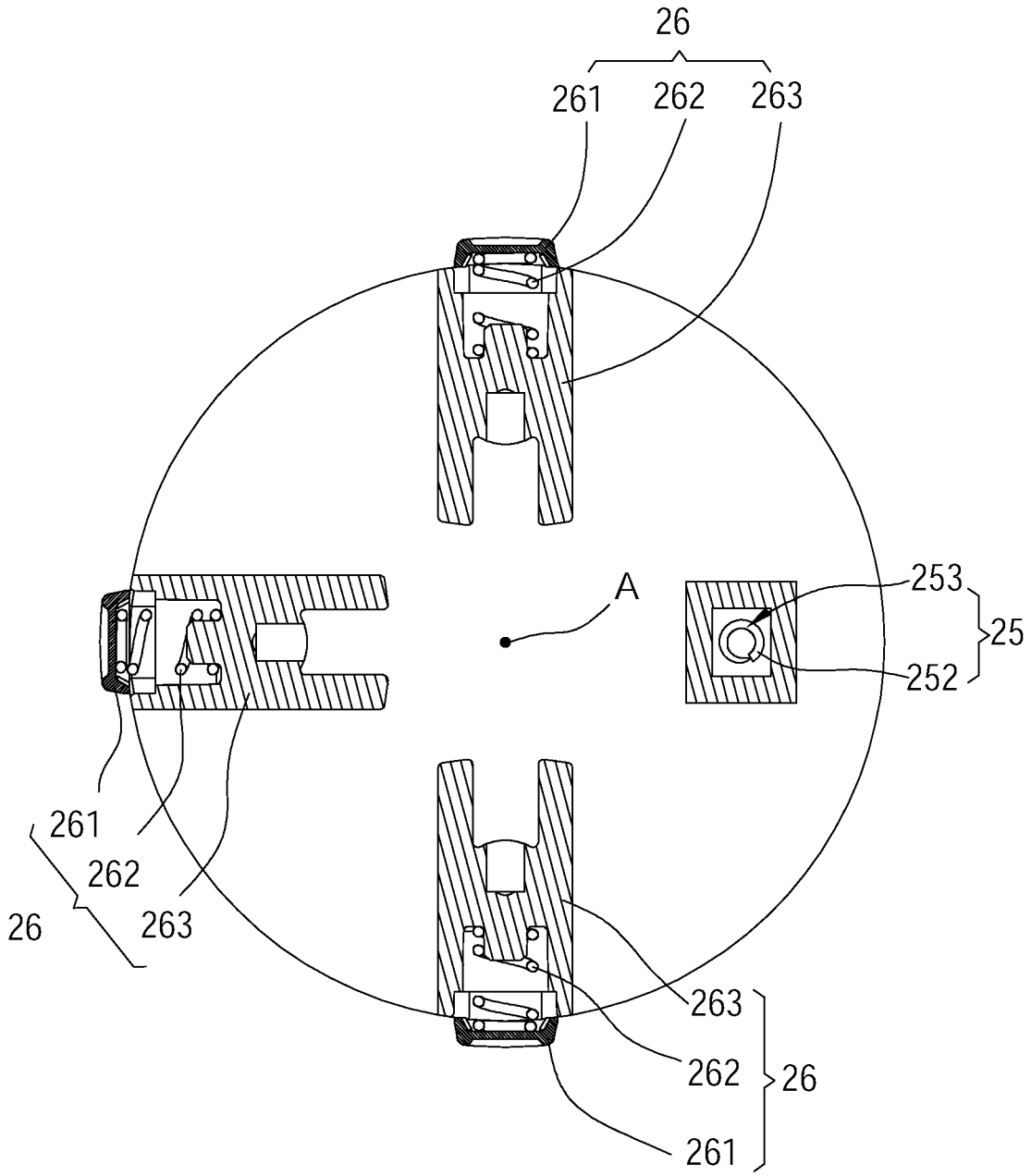
FIG. 6 is a cross-sectional view of a control member of the shower of one embodiment of the present disclosure.

In FIG. 3 and FIG. 4, the control member 20 includes a front circular pad 22, a rear circular pad 24 and at least three elastic blocks 26, wherein the front circular pad 22, the rear circular pad 24 and the accommodating space 1032 are co-axially positioned, whereby the control member 20 could be operated to rotate relative to the main body 10. In one embodiment of the present disclosure, the elastic blocks 26 are radially arranged between the front circular pad 22 and the rear circular pad 24. In one embodiment of the present disclosure, the elastic blocks 26 could be adapted to plug the outlet bores 123, 133, 143. And, in one embodiment of the present disclosure, the amount of the elastic blocks 26 is the same as that of the outlet bores 123, 133, 143.

In FIG. 6, FIG. 7A, FIG. 7B, FIG. 7C and FIG. 7D, the elastic blocks 26 are positioned on the same plane, and are orthogonal to an axis A of the control member 20. In addition, the outlet bores 123, 133, 143 are positioned on the same plane. In one embodiment of the present disclosure, all the elastic blocks 26 and all the outlet bores 123, 133, 143 are positioned on the same plane.

Furthermore, the control member 20 could be operated to stay at a closed position or at least three outlet mode positions, in order to provide the desired outlet function or to close the shower for users.

Figure 7A:
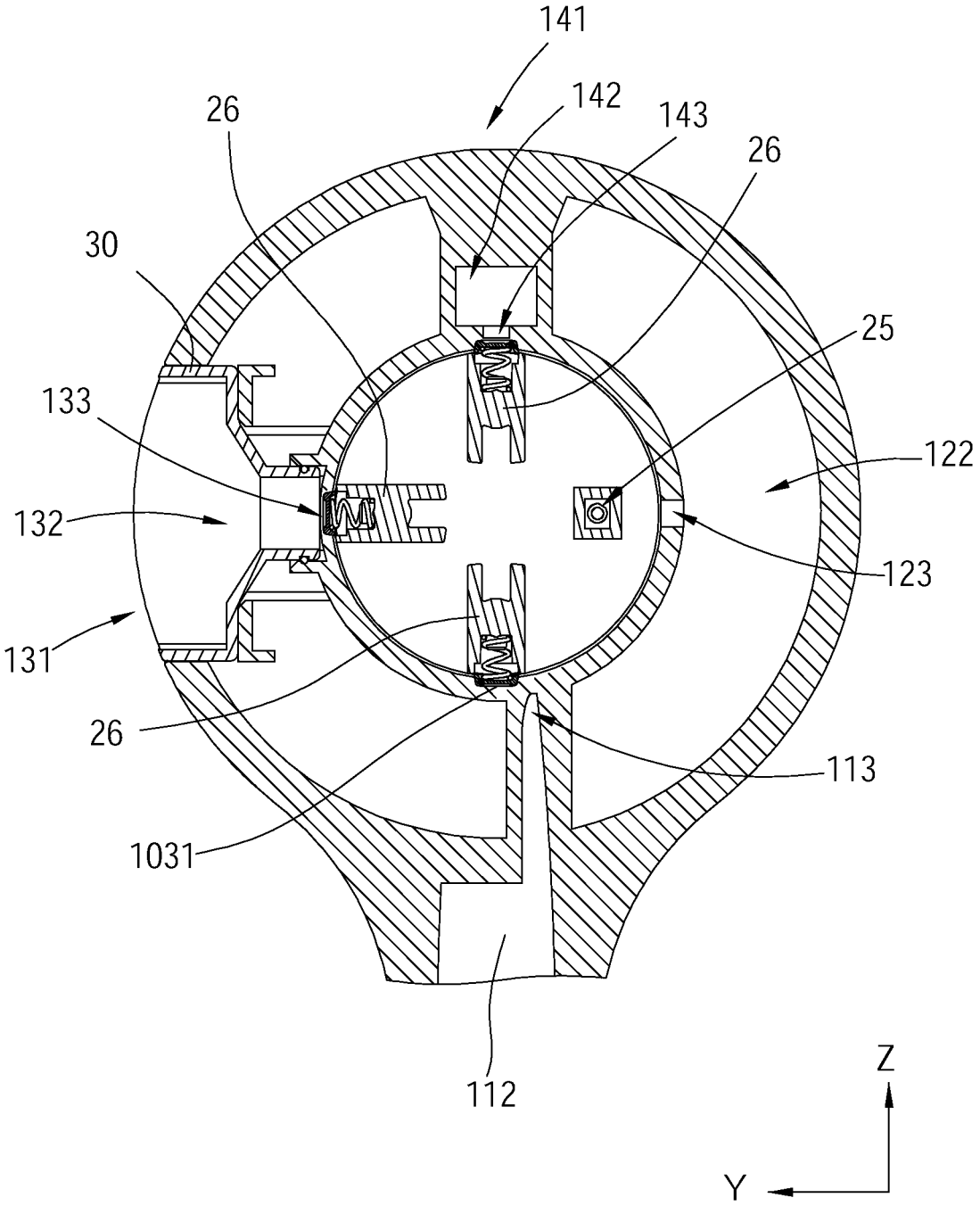
FIG. 7A is a cross-sectional view of a combination of the main body and the control member of the bottom unit while the control member stays at one of outlet mode positions, according to one embodiment of the present disclosure.

For example, in FIG. 7A, when the control member 20 stays at a first one of the outlet mode positions, only the outlet bore 123 is open, and other outlet bores 133, 143 are respectively plugged by one of the elastic blocks 26, whereby water could flow through the open outlet bore 123 to outlet from the corresponding outlet opening 121.

Figure 7B:
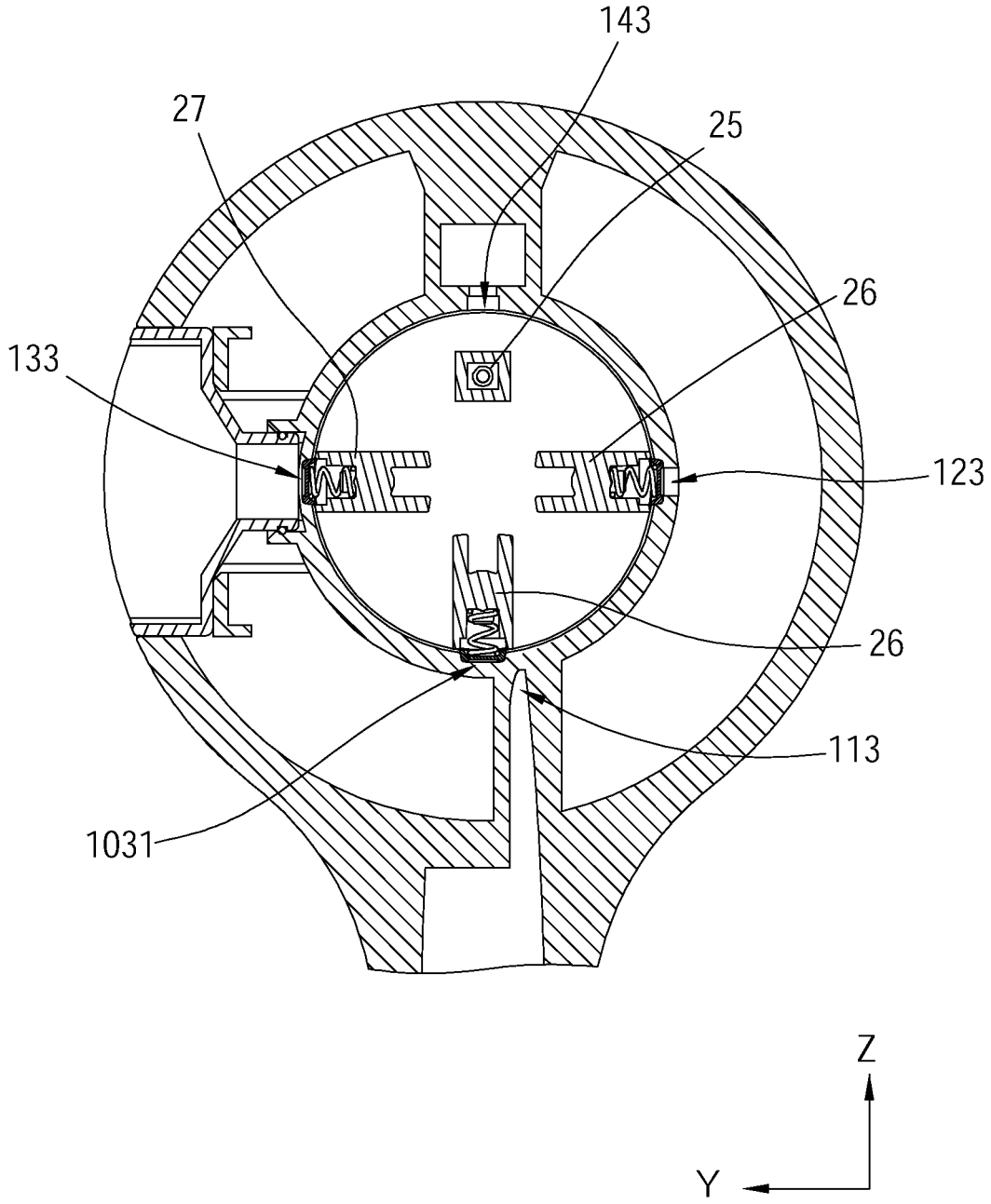
FIG. 7B is a cross-sectional view of a combination of the main body and the control member of the bottom unit while the control member stays at another one of outlet mode positions, according to one embodiment of the present disclosure.

In FIG. 7B, when the control member 20 stays at a second one of the outlet mode positions, only the outlet bore 133 is open, and other outlet bores 123, 143 are respectively plugged by one of the elastic blocks 26, whereby water could flow through the open outlet bore 133 to outlet from the corresponding outlet opening 131.

Figure 7C:
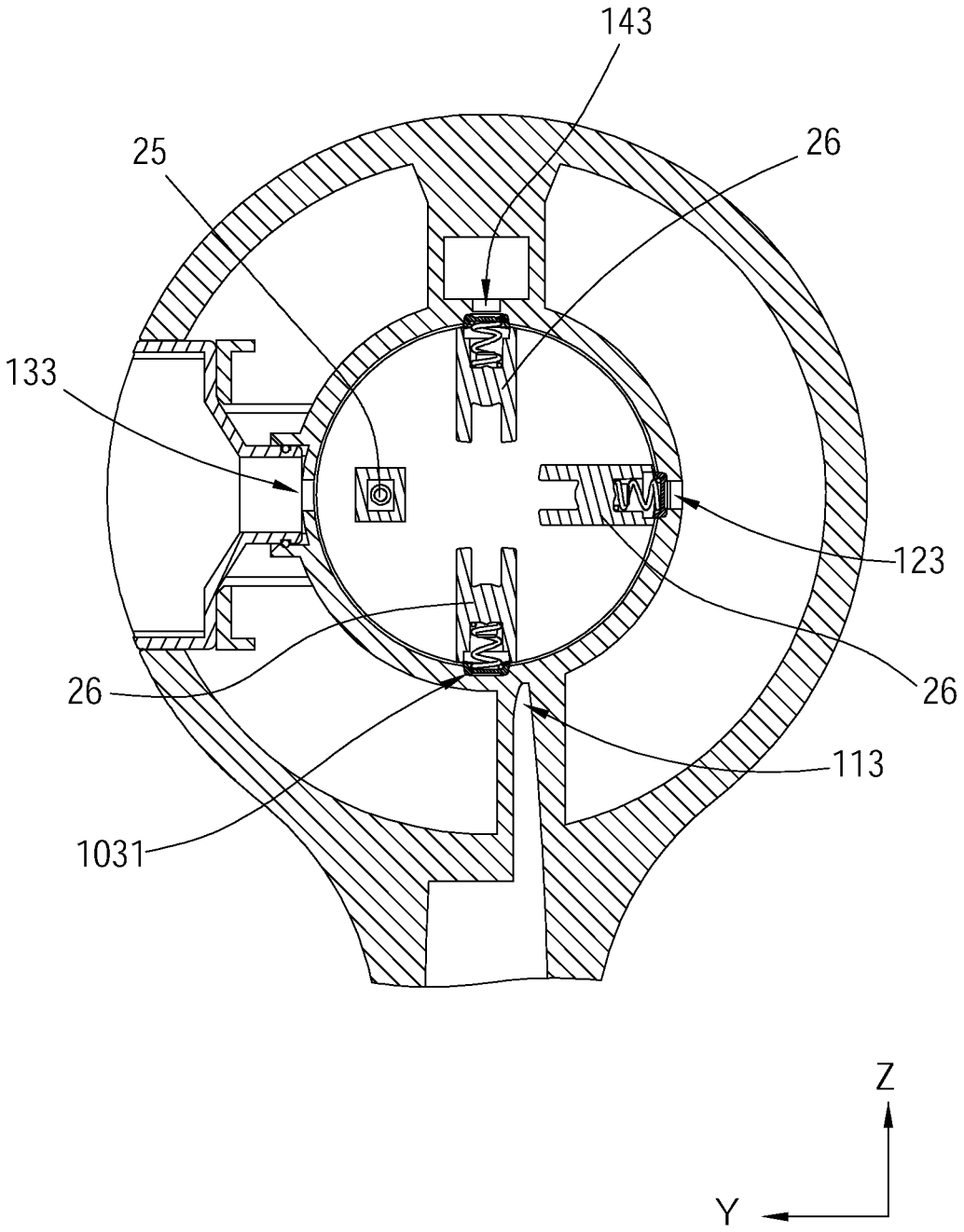
FIG. 7C is a cross-sectional view of a combination of the main body and the control member of the bottom unit while the control member stays at further another one of outlet mode positions, according to one embodiment of the present disclosure.

In FIG. 7C, when the control member 20 stays at a third one of the outlet mode positions, only the outlet bore 143 is open, and other outlet bores 123, 133 are respectively plugged by one of the elastic blocks 26, whereby water could flow through the open outlet bore 143 to outlet from the corresponding outlet opening 141.

Alternatively, when the control member 20 stays at the closed position, all the outlet bores 123, 133, 143 are respectively plugged by one of the elastic blocks 26, whereby water could not outlet from the shower 1.

In addition, the inner wall 103 of the main body 10 has an abutting point 1031 on an inner surface of the inner wall 103. When the control member 20 rotates to stay at one of the outlet mode positions, one of the elastic blocks 26 abuts against the abutting point 1031, as shown in FIG. 7A, FIG. 7B and FIG. 7C.

Figure 8:
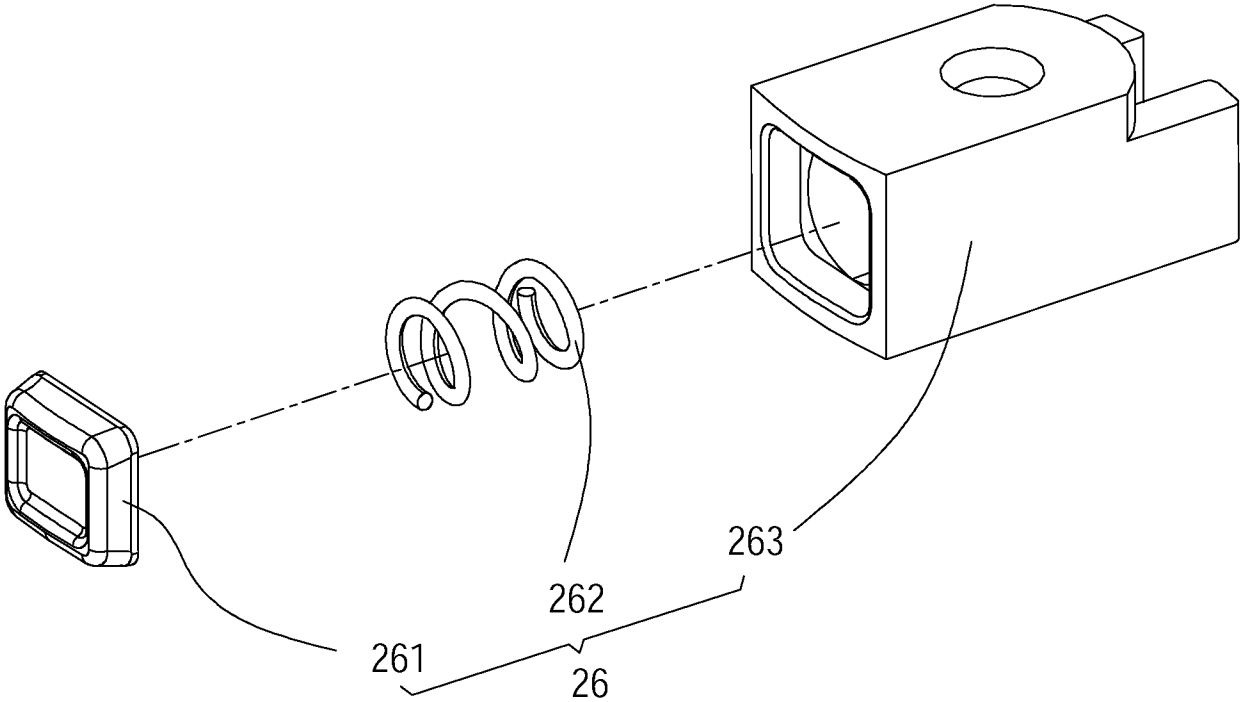
FIG. 8 is an exploded view of an elastic block of one embodiment of the present disclosure.

Referring FIG. 8, each of the elastic blocks 26 includes a blocking head 261, a spring 262 and a case 263. The blocking head 261 is retractably protruding from an outer edge of the case 263, and the blocking head 261 plugs one of the outlet bores 123, 133, 143 while the control member 20 rotates the elastic blocks 26 to stay at the closed position or one of the outlet mode positions.

However, it is worthy to note that, no matter how the control member 20 rotates, the elastic blocks 26 cannot plug the inlet bore 113. In one embodiment of the present disclosure, the elastic blocks 26 are positioned on different planes from the inlet bore 113, as shown in FIG. 7A, FIG. 7B, FIG. 7C and FIG. 7D.

Figure 2:
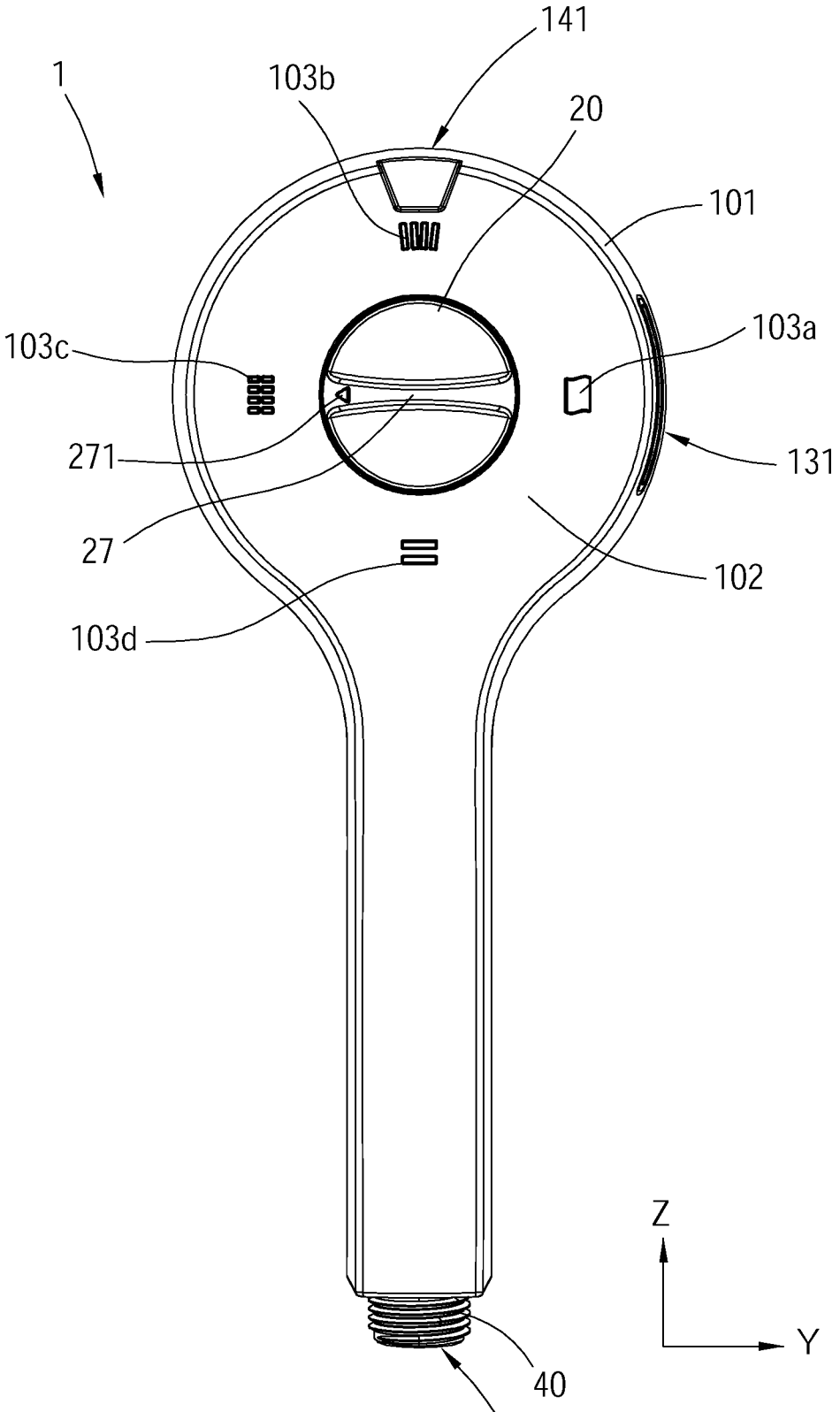
FIG. 2 is a rear view of the shower of one embodiment of the present disclosure.

Referring to FIG. 1, two of the outlet openings 121, 131, 141 are substantially orthogonal to each other while the amount of the outlet openings 121, 131, 141 is three. In other words, the outlet opening 121 and the outlet opening 131 are substantially orthogonal to each other, as shown in FIG. 1 and FIG. 3; the outlet opening 131 and the outlet opening 141 are substantially orthogonal to each other, as shown in FIG. 1 and FIG. 2; the outlet opening 121 and the outlet opening 141 are substantially orthogonal to each other, as shown in FIG. 1 and FIG. 4. However, the amount of the outlet openings is not limited in the present disclosure; in practice, the amount of the outlet openings could be more than three.

In one embodiment of the present disclosure, one of the outlet opening 121 is substantially parallel to the axis A of the control member 20, and the other outlet openings 131, 141 are substantially orthogonal to the axis A of the control member 201.

Figure 7D:
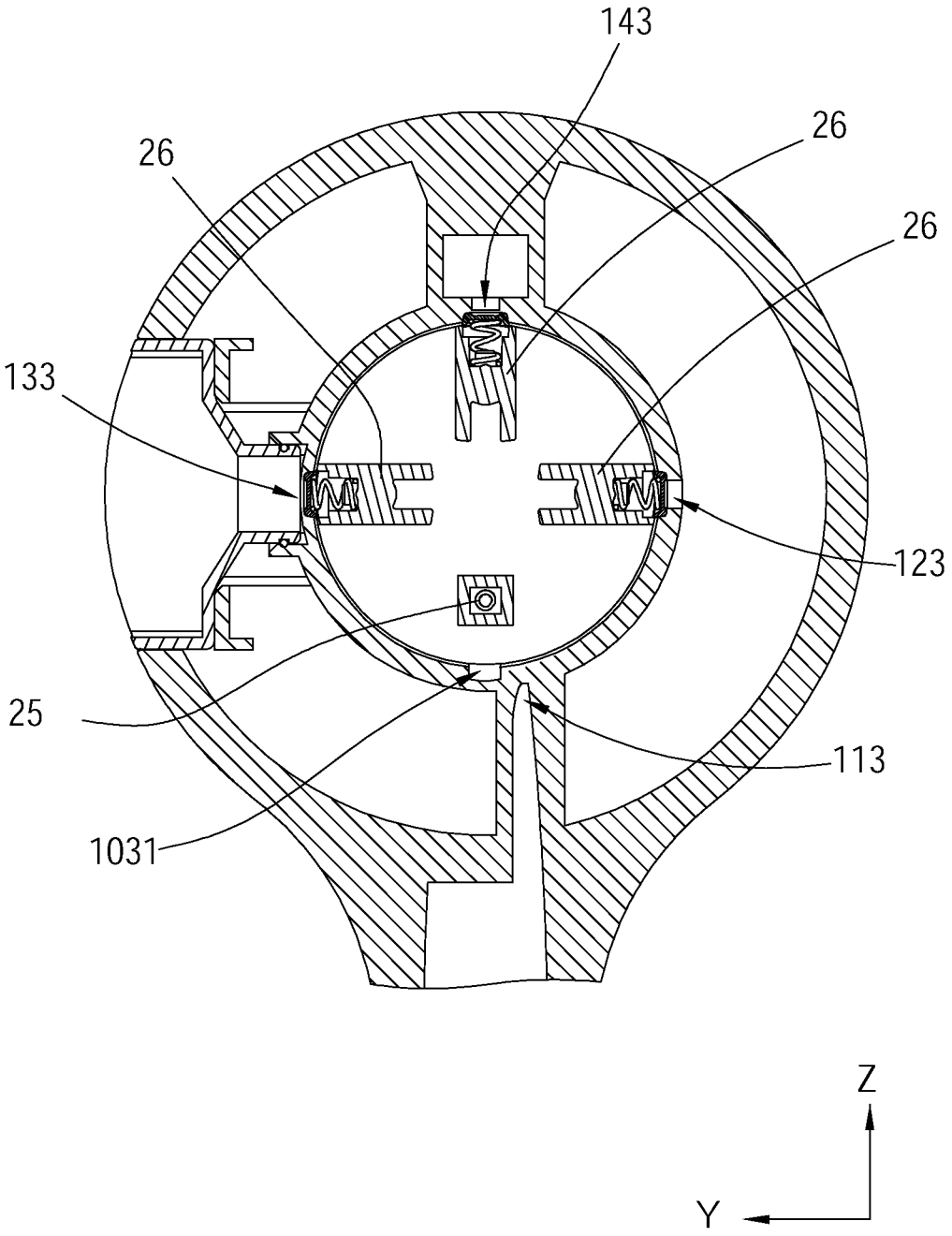
FIG. 7D is a cross-sectional view of a combination of the main body and the control member of the bottom unit while the control member stays at a closed position, according to one embodiment of the present disclosure.

It is worthy to note that, the rear wall 102 includes a plurality of mode marks 103*a*, 103*b*, 103*c*, 103*d* on an outer surface thereof, and the control member 20 includes an indicator 271. In one embodiment of the present disclosure, each of the mode marks 103*a*, 103*b*, 103*c*, 103*d* is corresponding to a corresponding one of the closed position and the outlet mode positions. When the control member 20 rotates to stay at the closed position or one of the outlet mode positions, the indicator 271 stays to indicate a corresponding one of the mode marks 103*a*, 103*b*, 103*c*, 103*d*. For example, when the control member 20 rotates to stay at the first outlet mode position as shown in FIG. 7A, the indicator 271 stays to indicate the corresponding mode marks 103*a*; when the control member 20 rotates to stay at the second outlet mode position as shown in FIG. 7B, the indicator 271 stays to indicate the corresponding mode marks 103*b*; when the control member 20 rotates to stay at the third outlet mode position as shown in FIG. 7C, the indicator 271 stays to indicate the corresponding mode marks 103*c*. Furthermore, when the control member 20 rotates to stay at the closed position as shown in FIG. 7D, the indicator 271 stays to indicate the corresponding mode marks 103*d*.

In FIG. 2, the control member 20 includes an operating portion 27, which is positioned on a rear surface of the rear circular pad 24 of the control member 20.

Referring to FIG. 3, FIG. 4, FIG. 10 and FIG. 11, the shower 1 includes a porous cover 50 covered over the outlet opening 121. In one embodiment of the present disclosure, the porous cover 50 includes a porous inner unit 52 and a porous outer unit 54, wherein the porous inner unit 52 is positioned between the porous outer unit 54 and the control member 20. In FIG. 4, a sealing ring 56 is positioned between the porous cover 50 and the control member 20. In one embodiment of the present disclosure, the sealing ring 56 is attached to the porous inner unit 52 of the porous cover 50 and the front circular pad 22 of the control member 20, in order to avoid water leaking from a gap between the porous cover 50 and the control member 20.

Figure 10:
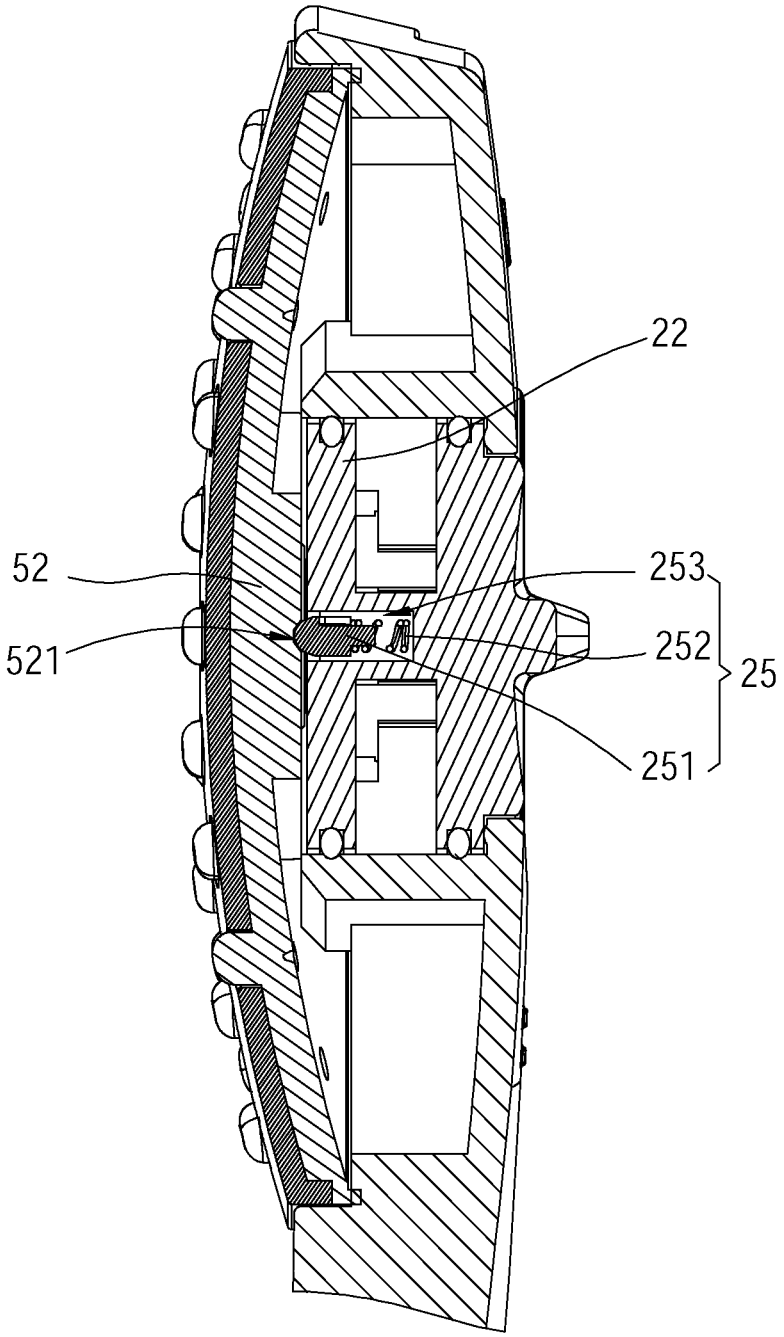
FIG. 10 is a cross-sectional view of the shower of one embodiment of the present disclosure.
Figure 10:
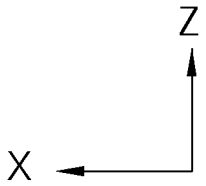
Figure 11:
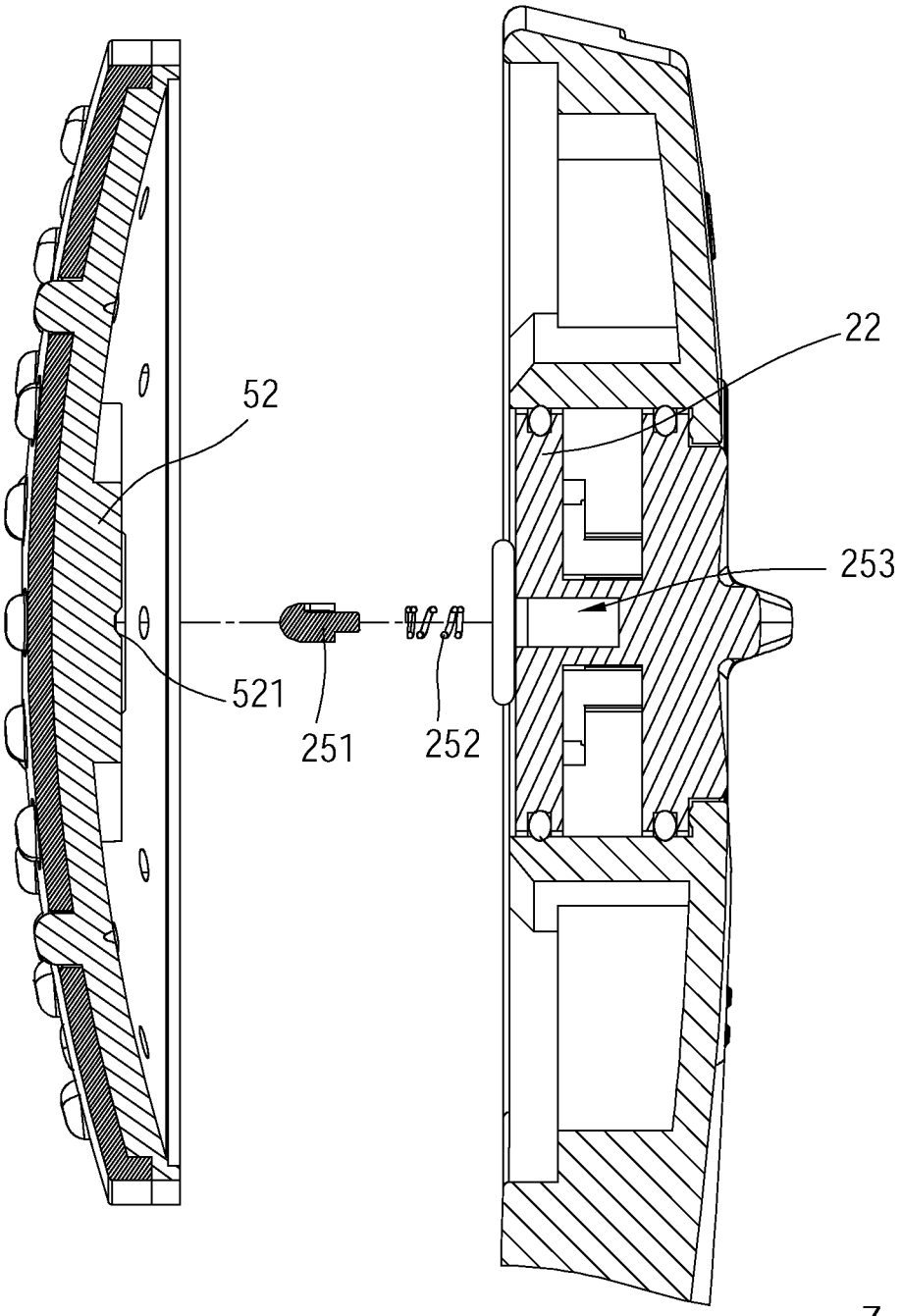
FIG. 11 is an exploded cross-sectional view of FIG. 10.

Referring to FIG. 10 and FIG. 11, the control member 20 includes a first recess 253 and an elastic positioning unit 25 positioned in the first recess 253, wherein the first recess 253 and the elastic positioning unit 25 are positioned facing to the porous cover 52. Further, the porous cover 52 has a plurality of second recesses 521 facing to the control member 20; actually, the second recesses 521 are positioned on a surface of the porous inner unit 52 facing to the control member 20. When the control member 20 rotates to stay at the closed position or one of the outlet mode positions, the elastic positioning unit 25 inserts into one of the second recesses 521. In one embodiment of the present disclosure, the elastic positioning unit 25 includes a pin head 251 and a spring 252, wherein one end of the spring 252 is connected to the pin head 251, and another end thereof is connected to a bottom of the first recess 253. In one embodiment of the present disclosure, each of the second recesses 521 is corresponding to a corresponding one of the closed position and the outlet mode positions.

Figure 12:
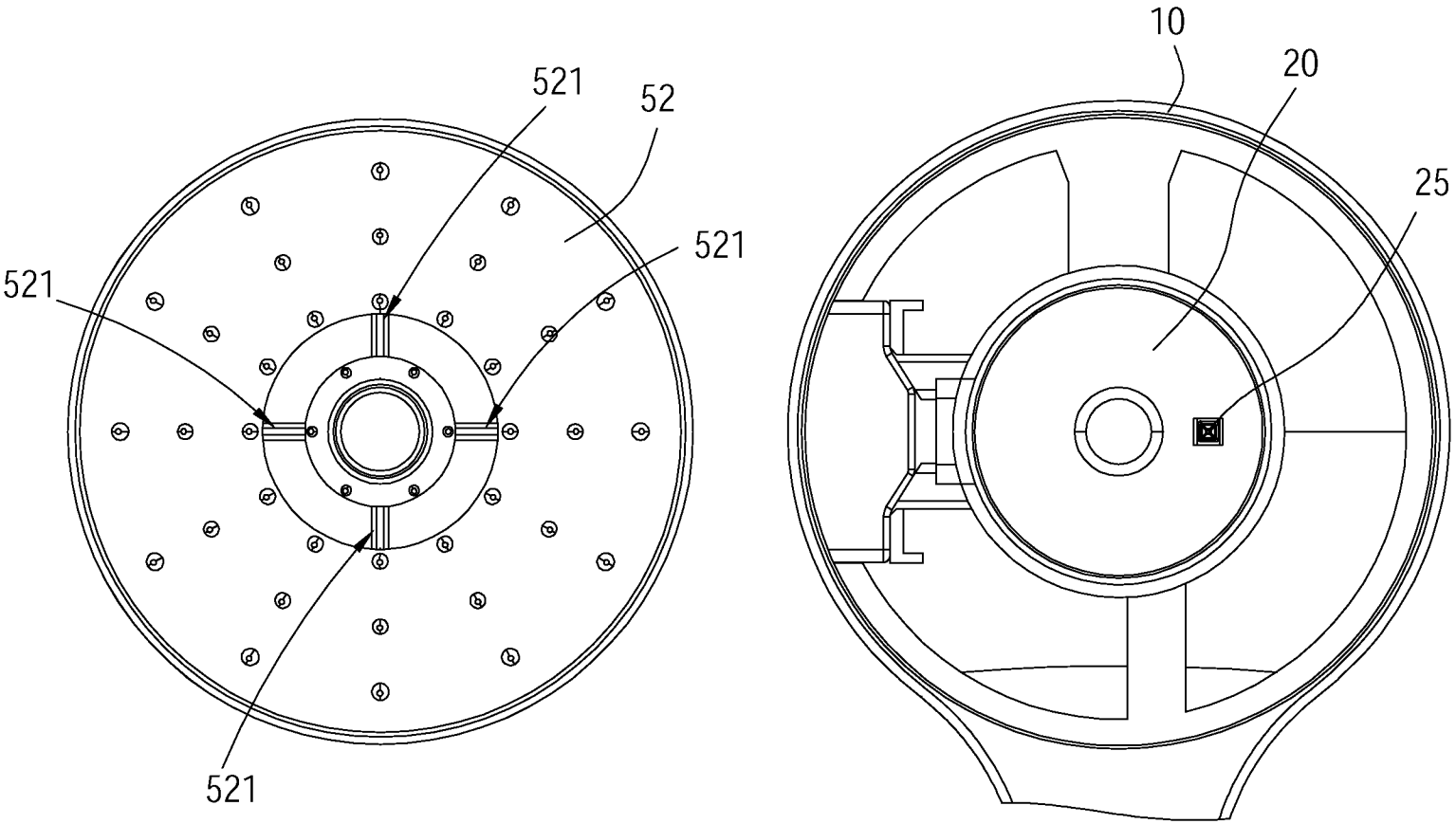
FIG. 12 is an exploded view of the shower of one embodiment of the present disclosure.

It is worthy to note that, when the elastic positioning unit 25 goes into the corresponding second recess 521, the attachment of the elastic positioning unit 25 and the corresponding second recess 521 would generate a positioning tone to voice that the control member 20 rotates to the closed position or one of the outlet mode positions, as shown in FIG. 12. The positioning tone is used to remind users that the control member 20 rotates to the closed position or one of the outlet mode positions, and the indicator 271 of the control member 20 stays at the closed position or the corresponding one of the outlet mode positions to indicate the corresponding one of the marks 143, whereby the user could accurately know that which one of the outlet openings 121, 131, 141 communicates with the inlet opening 111 by seeing one of the mode marks 103*a*, 103*b*, 103*c*, 103*d* indicated by the indicator 271 in conjunction with the accompanying positioning tone.

Figure 9:
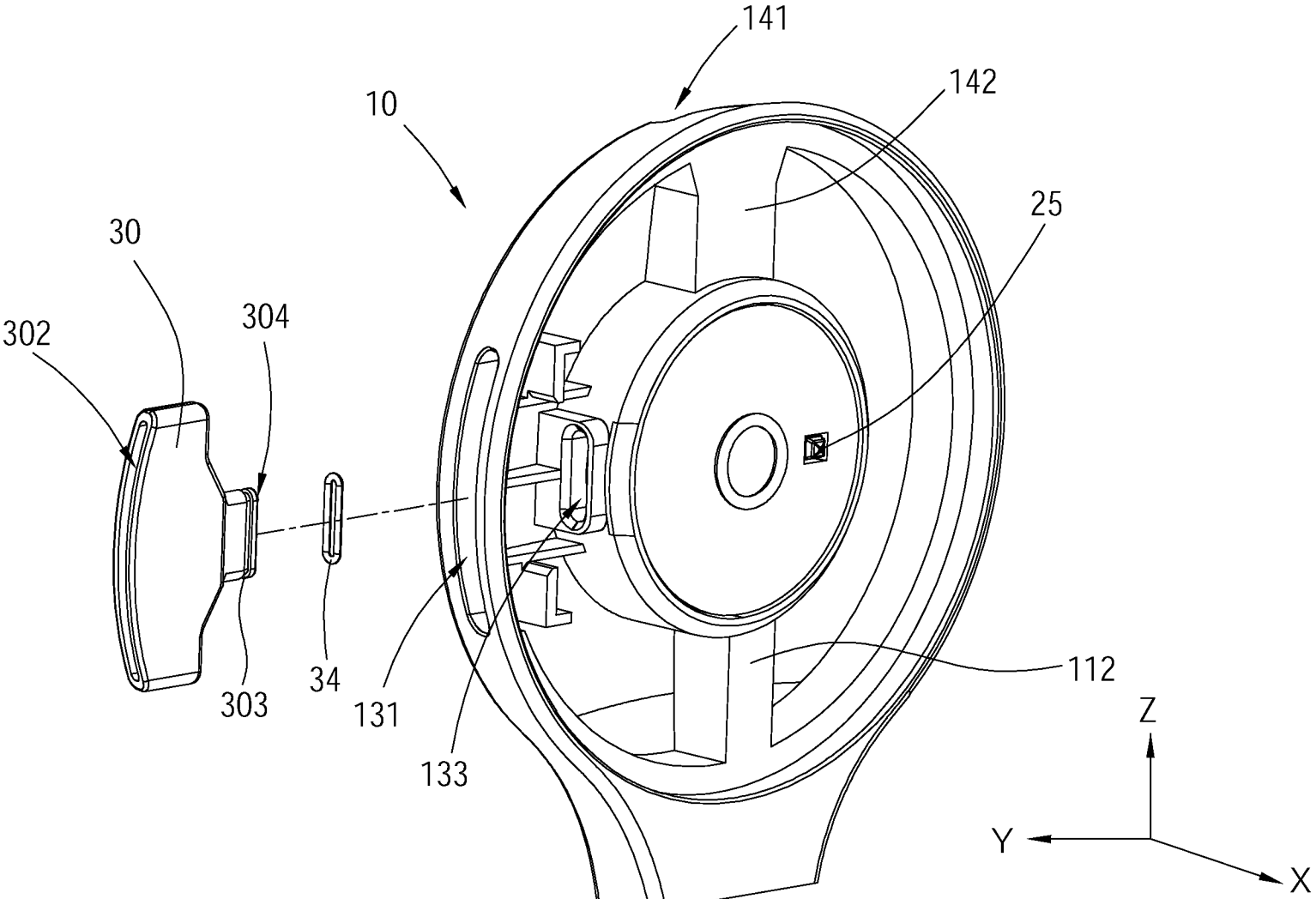
FIG. 9 is an exploded view of a functional outlet unit and the main body of one embodiment of the present disclosure.

Referring to FIG. 3 and FIG. 9, a functional outlet unit 30 is positioned in the outlet opening 131, in order to provide a soft water flow for a baby, a young child or a small pet, whereby to prevent from hurting by a strong flow. In one embodiment of the present disclosure, the functional outlet unit 30 has a narrow hole 304 and a broad hole 302 opposite to the narrow hole 304, and the hole size of the narrow hole 304 is less than that of the broad hole 302. The functional outlet unit 30 is also positioned in the outlet channel 132, the broad hole 302 is fitted to the outlet opening 131, and the narrow hole 304 is fitted to the outlet bore 133. In FIG. 9, a sealing ring 34 is positioned near the narrow hole 304 of the functional outlet unit 30, and positioned between the functional outlet unit 30 and the inner wall 103 of the main body 10, in order to avoid water leaking from a gap between the functional outlet unit 30 and the inner wall 103 of the main body 10. In one embodiment of the present disclosure, the sealing ring 34 is positioned in a recess 303 of the functional outlet unit 30 near the narrow hole 304.

It is worthy to note that, the outlet opening 141 is a resining opening for providing a strong water flow to clean a bath, and the opening size of the resining opening is less than the hole size of the broad hole 302 of the functional outlet unit 30, as shown in FIG. 12.

Referring to FIG. 3 and FIG. 4, a front sealing ring 21 and a rear sealing ring 23 are provided. The front sealing ring 21 is positioned between the front circular pad 22 and the inner wall 103 of the main body 10, in order to avoid water leaking from a gap between the front circular pad 22 and the inner wall 103 of the main body 10. The rear sealing ring 23 is positioned between the rear circular pad 24 and the inner wall 103 of the main body 10, in order to avoid water leaking from a gap between the rear circular pad 24 and the inner wall 103 of the main body 10.

Referring to FIG. 1, FIG. 2 and FIG. 3, an inlet connector 40 is connected to the main body 10 at the inlet opening 111. In one embodiment of the present disclosure, a sealing ring (not shown) positioned between the inlet connector 40 and the main body 10, in order to avoid water leaking from a gap between the inlet connector 40 and the main body 10.

With the aforementioned design, the control member of the shower could be operated to rotate to stay at the closed position or one of the outlet mode positions. When the control member stays at one of the outlet mode positions, only one outlet bore is open, and other outlet bores are respectively plugged by one of the elastic blocks, whereby the shower could provide a desired outlet function for users during use. Alternatively, all the outlet bores are respectively plugged by one of the elastic blocks when the control member stays at the closed position.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A shower, comprising:

a main body having an outer wall, an inner wall, and a rear wall; wherein the rear wall has a circular hole; the inner wall is connected to the rear wall at an edge of the circular hole, and the outer wall is connected to an outer edge of the rear wall; the inner wall surrounds the circular hole of the rear wall to form an accommodating space; the outer wall has an inlet opening and at least three outlet openings; the inner wall has an inlet bore and at least three outlet bores; the inlet opening communicates with the inlet bore through an inlet channel in the main body; each of the at least three outlet openings communicates with corresponding one of the at least three outlet bores through an outlet channel individually; and a control member positioned in the accommodating space; wherein the control member is adapted to be operated to select one of the at least three outlet openings for outputting water.

2. The shower of claim 1, wherein the control member is adapted to be operated to rotate relative to the main body; the control member comprises at least three elastic blocks adapted to plug the at least three outlet bores; wherein the control member could be operated to stay at either a closed position or one of at least three outlet mode positions; when the control member stays at each of the at least three outlet mode positions, only corresponding one of the at least three outlet bores is open, and the others of the at least three outlet bores are respectively plugged by one of the at least three elastic blocks; when the control member stays at the closed position, each of the at least three outlet bores is plugged by one of the at least three elastic blocks.

3. The shower of claim 2, wherein the at least three elastic blocks are unable to plug the inlet bore.

4. The shower of claim 2, further comprising a porous cover covered over one of the at least three outlet openings, which is opposite to the rear wall.

5. The shower of claim 4, wherein the control member comprises a first recess and an elastic positioning unit which is positioned in the first recess, wherein the first recess and the elastic positioning unit are positioned facing to the porous cover, and the porous cover has a plurality of second recesses facing to the control member; the elastic positioning unit abuts against one of the plurality of second recesses when the control member is rotated to stay at the closed position or at one of the at least three outlet mode positions.

6. The shower of claim 5, wherein when the elastic positioning unit abuts against one of the plurality of second recesses, the elastic positioning unit hits the one of the plurality of second recesses to generate a positioning tone to voice that the control member rotates to the closed position or to one of the at least three outlet mode positions.

7. The shower of claim 5, wherein each of the second recesses is adapted to position the control member in either the closed position or one of the at least three outlet mode positions.

8. The shower of claim 2, wherein each of the at least three elastic blocks comprises a blocking head and a case, the blocking head is retractably protruding from an outer edge of the case, and each of the blocking heads plugs one of the outlet bores while the control member rotates to stay at either the closed position or one of the at least three outlet mode positions.

9. The shower of claim 2, wherein a number of the elastic blocks is equal to a number of the outlet bores.

10. The shower of claim 2, wherein each two of the at least three outlet openings are substantially orthogonal to each other when a number of the at least three outlet openings is three.

11. The shower of claim 2, wherein one of the at least three outlet openings is substantially parallel to a rotation axis of the control member, and the other outlet openings are substantially orthogonal to the rotation axis of the control member when a number of the at least three outlet openings is three.

12. The shower of claim 2, wherein the elastic blocks are positioned on the same plane, and are orthogonal to an axis of the control member.

13. The shower of claim 2, wherein the elastic blocks are positioned on the same plane, and the inlet bore is not disposed on the same plane which is disposed with the elastic blocks.

14. The shower of claim 2, wherein the inner wall of the main body has an abutting point on an inner surface of the inner wall; when the control member rotates to stay at one of the at least three outlet mode positions, one of the elastic blocks abuts against the abutting point.

15. The shower of claim 2, wherein the rear wall comprises a plurality of mode marks on an outer surface of the rear wall, and the control member comprises an indicator; each of the plurality of mode marks corresponds to one of the closed position and the at least three outlet mode positions; when the control member is rotated to stay at the closed position or one of the at least three outlet mode positions, the indicator indicates a corresponding one of the plurality of mode marks.

16. The shower of claim 2, wherein the control member comprises a front circular pad and a rear circular pad; the front circular pad, the rear circular pad and the accommodating space are co-axially positioned, whereby the control member is adapted to be operated to rotate relative to the main body.

17. The shower of claim 16, wherein the elastic blocks are radially arranged between the front circular pad and the rear circular pad.

18. The shower of claim 1, further comprising a functional outlet unit positioned in one of the at least three outlet openings, wherein one of the at least three outlet openings disposed with the functional outlet unit has an axis perpendicular to an axis of the control member and an axis of the inlet channel; the functional outlet unit has a narrow hole and a broad hole which is opposite to the narrow hole, and a hole size of the narrow hole is less than a hole size of the broad hole.

19. The shower of claim 18, wherein one of the at least three outlet openings is a resining opening, and an opening size of the resining opening is less than the hole size of the broad hole of the functional outlet unit.

20. The shower of claim 1, wherein the outlet bores are positioned on the same plane.

* * * * *